US008354635B2

(12) United States Patent
Yamaguchi

(10) Patent No.: US 8,354,635 B2
(45) Date of Patent: Jan. 15, 2013

(54) MASS SPECTROMETER

(75) Inventor: Shinichi Yamaguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/126,455

(22) PCT Filed: Oct. 30, 2008

(86) PCT No.: PCT/JP2008/003105
§ 371 (c)(1),
(2), (4) Date: Apr. 27, 2011

(87) PCT Pub. No.: WO2010/049972
PCT Pub. Date: Jun. 5, 2010

(65) Prior Publication Data

US 2011/0215239 A1 Sep. 8, 2011

(51) Int. Cl.
*H01J 49/40* (2006.01)

(52) U.S. Cl. ..... 250/287

(58) Field of Classification Search ..... 250/288, 250/287, 282, 281; 702/23, 26, 27
See application file for complete search history.

(56) References Cited

U.S. PATENT DOCUMENTS 6,906,321 B2 * 6/2005 Yamaguchi ..... 250/287
7,091,480 B2 * 8/2006 Yamaguchi et al. ..... 250/287
7,196,324 B2 * 3/2007 Verentchikov ..... 250/287
7,211,792 B2 * 5/2007 Yamaguchi ..... 250/287
7,361,889 B2 * 4/2008 Yamaguchi ..... 250/287
8,164,054 B2 * 4/2012 Nishiguchi et al. ..... 250/287
(Continued)

FOREIGN PATENT DOCUMENTS

JP 2005-116343 4/2005
(Continued)

OTHER PUBLICATIONS

Japanese language international preliminary report on patentability dated Jun. 7, 2011 and its English language translation for corresponding PCT application PCT/JP2008/003105.

(Continued)

*Primary Examiner* — Jack Berman
*Assistant Examiner* — Johnnie L Smith
(74) *Attorney, Agent, or Firm* — DLP Piper US LLP

(57) ABSTRACT

Ions originating from sample components are made to fly along a loop orbit (P) multiple times, and are deviated from the loop orbit (P) when a predetermined period of time has elapsed after the ejection of the ions. A time-of-flight spectrum recording unit (81) creates a time-of-flight spectrum based on the detected signal. If an overtaking of ions occurs on the loop orbit (P), the number of turns of peaks (ions) appearing on the spectrum cannot be determined. Given this factor, an isotopic peak detector (82) finds an isotopic peak group based on the time intervals and intensity ratio of a plurality of peaks appearing on the spectrum. A flight distance computation unit 83 uses the fact that the mass difference between adjacent peaks belonging to an isotopic peak group is 1 Da when ions are singly-charged, and computes the flight distance based on a predetermined formula. From the flight distance, a mass computation unit (84) computes the number of turns, and recomputes the flight distance which is structurally determined from this number of turns. Then, the mass computation unit (84) computes the mass of the target component. This enables an acquisition of the accurate mass free of the influence of an overtaking of ions and other factors.

4 Claims, 1 Drawing Sheet

U.S. PATENT DOCUMENTS

| | | | | |
|---|---|---|---|---|
| 8,258,467 | B2 * | 9/2012 | Kajihara | 250/287 |
| 8,263,932 | B2 * | 9/2012 | Yamaguchi | 250/287 |
| 2005/0017169 | A1 * | 1/2005 | Yamaguchi | 250/288 |
| 2006/0219890 | A1 * | 10/2006 | Yamaguchi | 250/287 |

FOREIGN PATENT DOCUMENTS

| | | |
|---|---|---|
| JP | 2006-012747 | 1/2006 |
| JP | 2006-228435 | 8/2006 |
| JP | 2006-278145 | 10/2006 |
| JP | 2008-027683 | 2/2008 |

OTHER PUBLICATIONS

Japanese language office action dated Jul. 24, 2012 and its English language translation issued in corresponding Japanese application 2010535517.

* cited by examiner

MASS SPECTROMETER

CROSS-REFERENCE TO THE RELATED APPLICATIONS

This application is a national stage of international application No. PCT/JP2008/003105, filed on Oct. 30, 2008, the entire content of which is incorporated herein by reference.

TECHNICAL FIELD

The present invention relates to a multi-turn time-of-flight mass spectrometer in which ions originating from a sample are made to repeatedly fly along a closed loop orbit to separate and detect them in accordance with their mass (to be exact, their mass-to-charge ratio).

BACKGROUND ART

A "Time-of-Flight Mass Spectrometer" (TOF-MS) is a type of device used for performing a mass analysis by measuring the time of flight required for each ion to travel a specific distance and converting the time of flight to the mass. This analysis is based on the principle that ions accelerated by a certain amount of energy will fly at different speeds corresponding to their mass. Accordingly, elongating the flight distance of ions is effective for enhancing the mass resolving power. However, the elongation of a flight distance along a straight line requires an enlargement of the device. Given this factor, Multi-Turn Time-of-Flight Mass Spectrometers (Multi-Turn TOF-MS) have been developed in which ions are made to repeatedly fly along a closed orbit such as a substantially circular shape, substantially elliptical shape, substantially "8" figure shape, or other shapes, in order to simultaneously achieve the elongation of the flight distance and the downsizing of the apparatus (refer to Patent Documents 1 and 2, and other documents).

Another type of device developed for the same purpose is the multi-reflection time-of-flight mass analyzer, in which the aforementioned loop orbit is replaced by a reciprocative path in which a reflecting electric field is created to make ions fly back and forth multiple times and thereby elongate their flight distance. Although the multi-turn time-of-flight type and the multi-reflection time-of-flight type use different ion optical systems, they are essentially based on the same principle for improving the mass resolving power. Accordingly, in the context of the present description, the "multi-turn time-of-flight type" should be interpreted as inclusive of the "multi-reflection time-of-flight type."

As previously described, a multi-turn time-of-flight mass spectrometer can achieve a high level of mass resolving power. However, it has a drawback due to the fact that the flight path of the ions is a closed orbit. That is, as the number of turns of the ions increases when they are made to fly along the closed orbit, an ion having a smaller mass and flying faster overtakes another ion having a larger mass and flying at a lower speed. If such an overtaking of the ions having different masses occurs, it is possible that some of the peaks observed on an obtained time-of-flight spectrum correspond to multiple ions that have undergone a different number of turns, i.e. traveled different flight distances. This means it is no longer ensured that the mass and the time of flight uniquely correspond, so that the time-of-flight spectrum cannot be directly converted to a mass spectrum.

Because of the aforementioned problem, in conventional multi-turn time-of-flight mass spectrometers, ions are selected in advance among the ions that originate from a sample generated in an ion source so that their mass is limited to a range where the aforementioned overtaking will not occur. The selected ions are made to fly along the loop orbit to undergo a predetermined number of turns and then be detected. Although a mass spectrum with a high mass resolution can be obtained with such a method, the range of the mass spectrum is significantly limited.

Patent Document 3 and other documents propose a method for performing a data processing function in which the results obtained by performing a plurality of mass analyses of the same sample under different conditions are compared to deduce the number of turns of the peaks appearing on a mass spectrum. However, this method requires the same sample to be mass analyzed plural times. Hence, the measurement takes a long time, and the amount of the sample is required that much.

[Patent Document 1] JP-A 2006-228435
[Patent Document 2] JP-A 2008-27683
[Patent Document 3] JP-A 2005-116343

DISCLOSURE OF THE INVENTION

Problems to be Solved by the Invention

The present invention has been developed in view of the aforementioned problems and the objective thereof is to provide a multi-turn time-of-flight mass spectrometer capable of obtaining a mass of the target component with a high mass resolution, based on a time-of-flight spectrum obtained by a single mass analysis.

Means for Solving the Problems

To solve the aforementioned problem, the present invention provides a multi-turn time-of-flight mass spectrometer having: an ion source for ionizing a sample; an ion optical system for forming a loop orbit along which ions originating from the sample are made to fly repeatedly; and a detector for detecting ions which have flown along the loop orbit, including:

a) a spectrum creator for creating a time-of-flight spectrum based on a signal obtained by the detector after ions originating from the sample are made to fly along the loop orbit for a predetermined period of time;

b) an isotopic peak detector for detecting a peak of a target component and a peak of an isotope of the target component based on at least time intervals between a plurality of peaks appearing on the time-of-flight spectrum; and c) a mass computing means for deducing a flight distance of an ion originating from the target component based on flight times corresponding to the peak of the target component and the peak of the isotope, and for computing a mass of the target component based on the flight distance.

Generally, elements which constitute a compound have stable isotopes with different masses. Hence, due to the difference of the isotope composition, a plurality of different peaks originating form the same compound and having different masses appear on the time-of-flight spectrum. The plurality of peaks form an isotopic peak group containing: a peak of the main ion which is composed only of the isotope having the largest natural abundance ratio; and peaks of ions (isotopic ions) including the other isotopes. In the case of a singly-charged ion, the adjacent peaks which belong to the isotopic peak group should be spaced apart at equal intervals of time corresponding to 1 Da. Hence, the isotopic peak detector detects an isotopic peak group based on the time intervals between the plurality of peaks.

The intensity ratio of the plurality of peaks belonging to the same isotopic peak group is supposed to correspond to the natural abundance ratio of the isotopes of the elements constituting the compound. Therefore, the isotopic peak detector may detect the peak of the target component and the peak of the isotope of the target component by using not only the time intervals of the plurality of peaks, but also the intensity ratio based on the isotope abundance ratio of elements constituting the target component.

If the flight time T1 of the ion corresponding to the main peak of the target component having a mass of M and the flight time T2 corresponding to the ion of the isotopic peak of the target component having a mass of M+1 are known, their common flight distance can be obtained from these flight times. When the flight time is obtained, the mass of the target component can be computed therefrom. However, in order to increase the accuracy of the computation of mass, the mass computing means may preferably compute the number of turns of ions originating from the target component from the deduced flight distance, recompute the accurate structurally-determined flight distance from the number of turns, and compute the mass of the target component. In this manner, it is possible to accurately compute the mass of the target component by using the flight distance which is precisely determined from the arrangement of the ion optical system, the positions of the ion source and the detector, and other factors.

The deduction of the flight distance and the computation of the mass can be performed for each of isotopic peak groups, as long as ions corresponding to the plurality of peaks which belong to one isotopic peak group and originate from the same target component have completed the same number of turns. Therefore, the deduction and the computation can be performed without any problem even if ions originating from different target components overtake each other and thereby cause the mixture of ions having completed different number of turns on the time-of-flight spectrum. Therefore, it is not necessary to limit the mass range which can be measured in one mass analysis to a narrow range.

Effects of the Invention

With the mass spectrometer according to the present invention, it is possible to obtain the mass of a target component with a high mass resolution over a large mass range by using a time-of-flight spectrum obtained by a single mass analysis. This reduces the measurement time to allow an effective analysis, and also eliminates the need for preparing a large amount of sample.

EXPLANATION OF NUMERALS

1 . . . Ion Source
2 . . . Gate Electrode
3 . . . Flight Space
31 through 36 . . . Sector-Shaped Electrode
4 . . . Detector
5 . . . Loop Flight Voltage Generator
6 . . . Gate Voltage Generator
7 . . . Controller
8 . . . Data Processor
81 . . . Time-of-Flight Spectrum Recording Unit
82 . . . Isotopic Peak Detector
83 . . . Flight Distance Computation Unit
84 . . . Mass Computation Unit
9 . . . Operation Unit
10 . . . Display Unit
P . . . Loop Orbit
E1 through E6 . . . Sector-Shaped Electric Field

BEST MODE FOR CARRYING OUT THE INVENTION

A multi-turn time-of-flight mass spectrometer according to an embodiment of the present invention will be described with reference to the attached figures.

Figure 1:
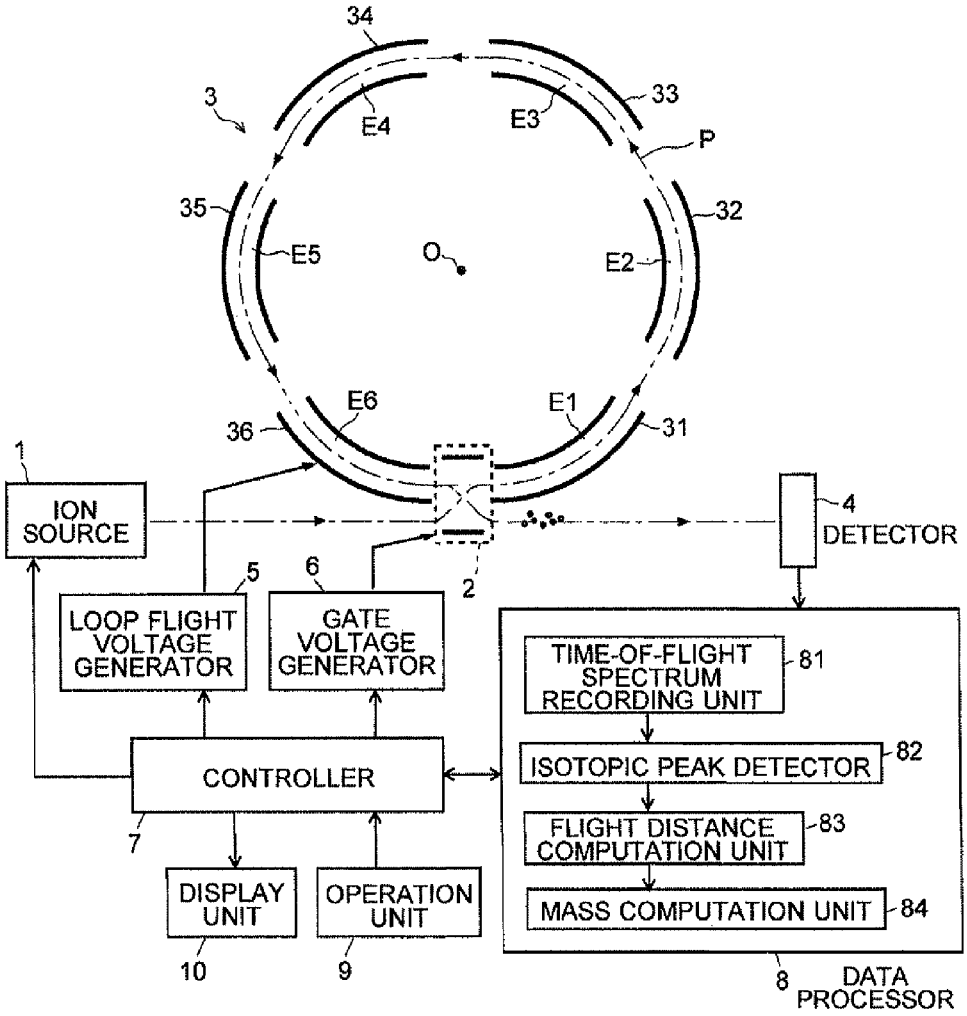
FIG. 1 is a schematic configuration diagram of a multi-turn time-of-flight mass spectrometer according to an embodiment of the present invention.

FIG. 1 is a schematic configuration diagram of the multi-turn time-of-flight mass spectrometer of the present embodiment. An ion source 1, a gate electrode 2, a flight space 3 in which a plurality of sector-shaped electrodes 31 through 36 are arranged, a detector 4, and other units are provided in a vacuum chamber (not shown).

The ion source 1 serves as the point where ions to be measured start to fly. It is an ionization unit, for example, for ionizing sample molecules to be analyzed, and the ionization method is not particularly limited. In the case where the present mass spectrometer is used as a detector for a gas chromatograph, the ion source 1 ionizes gaseous molecules by an electron impact ionization method or a chemical ionization method. In the case where the present mass spectrometer is used as a detector for a liquid chromatograph, the ion source 1 ionizes liquid molecules by an atmospheric pressure chemical ionization method or an electrospray ionization method. In the case where the molecule to be analyzed is a macromoleculer compound such as protein, a matrix assisted laser desorption ionization (MALDI) method can be used. The ion source 1 does not necessarily have to generate ions, but can be an ion trap, for example, for temporarily storing ions generated in another unit and then giving them energy to eject them.

In the flight space 3, a plurality (six, in this example) of sector-shaped electrodes 31, 32, 33, 34, 35, and 36 are arranged to make ions fly along a substantially circular loop orbit P. Each of the six identically-shaped sector-shaped electrodes 31 through 36 has a shape that is obtained by cutting a concentric double cylinder with a central angle of 60 degrees. The sector-shaped electrodes 31 through 36 are arranged around the axis 0 with the same rotational angular separation. By applying a predetermined voltage to the sector-shaped electrodes 31 through 36, sector-shaped electric fields E1 through E6 are respectively formed within these electrodes. A flight space with a substantially hexagonal cross section is formed in the sector-shaped electric fields E1 through E6, and ions that pass in this flight space have the center orbit as shown by P in FIG. 1. A gate electrode 2 provided between the adjacent sector-shaped electrodes 31 and 36 has a function of putting ions generated in the ion source 1 into the loop orbit P and deviating ions flying along the loop orbit P from there to send them to the detector 4.

A voltage is applied to the sector-shaped electrodes 31 through 36 and to the gate electrode 2 respectively from a loop flight voltage generator 5 and from a gate voltage generator 6. These voltage generators 5 and 6 are controlled by a controller 7. Connected to the controller 7 are an operation unit 9 which is operated by a user to enter a variety of settings and instructions relating to an analysis and a display unit 10 for displaying an analysis result and other information. The detection signal from the detector 4 is provided to a data processor 8, where the time of flight from a point in time when an ion departs from the ion source 1 until it reaches the detector 4 is measured and then the mass of the ion is computed based on this time of flight. Specifically, the data processor 8 includes, as function blocks, a time-of-fight spectrum recording unit 81, an isotopic peak detector 82, a flight distance computation unit 83, a mass computation unit 84, and other units. The controller 7 and the data processor 8 can be realized mainly by a personal computer.

In the configuration of FIG. 1, the loop orbit P has a substantially circular shape. However, the shape of the loop orbit P is not limited to this type; it can be any shape, such as an elliptical orbit or "8" figured loop orbit. For example, it may be a reciprocating linear orbit or curved orbit.

In the previously described mass spectrometer, a time-of-flight spectrum is obtained by performing a mass analysis of a target sample in the following manner. That is, under the control of the controller 7, the target sample is ionized in the ion source 1 and a variety of generated ions originating from the sample are ejected therefrom. Simultaneously, the controller 7 sends a control signal for notifying the data processor 8 of the ejection of ions. Immediately after the ions are ejected, the gate voltage generator 6 begins to apply, to the gate electrode 2, a deflection voltage for deflecting ions entering the gate electrode 2 in order to put the ions into the loop orbit 2. When a predetermined period of time has elapsed, the gate voltage generator 6 halts the application of the deflection voltage to the gate electrode 2. The loop flight voltage generator 5 applies a predetermined voltage to each of the sector-shaped electrodes 31 through 36, whereby all or almost all of the ions departed from the ion source 1 are introduced into the loop orbit P and start to fly along the loop orbit P.

Ions having a smaller mass have a larger velocity, and thus fly faster. Consequently, as the time advances after the ions are introduced into the loop orbit P, ions having close masses become separated and an ion having a small mass catches and overtakes an ion having a large mass. Therefore, if the passage of ions is observed at a certain point (e.g. at the gate electrode 2), the ions initially pass that point in the ascending order of their mass (while the number of turns is small), but their order of passage will be disordered as the number of turns increases.

At the point in tine when a predetermined period of time has elapsed after the point in time when ions are ejected from the ion source 1, the gate voltage generator 6, under the control of the controller 7, applies a deflection voltage for deflecting ions in such a manner that ions which will pass the gate electrode 2 leave the loop orbit P and proceed to the detector 4. The ion that is the closest to the gate electrode 2 in the opposite direction (i.e. clockwise in FIG. 1) of the travelling direction of ions at the point in time when the voltage applied to the gate electrode 2 is changed as just described first passes the gate electrode 2 and leaves the loop orbit P, followed by the other ions, which pass the gate electrodes 2 and leave the loop orbit P to proceed to the detector 4 in their positional order in the opposite direction of the travelling direction of ions. As described earlier, when a certain period of time has elapsed after ions are introduced into the loop orbit P, the ions passing the gate electrode 2 in the aforementioned manner are no longer in the ascending order of their mass. Therefore, ions do not reach the detector 4 in the ascending order of their mass.

The detector 4 provides in real time, to the data processor 8, an ion intensity signal corresponding to the number of incident ions. The time-of-flight spectrum recording unit 81 creates a time-of-flight spectrum by recording the ion intensity signal as time progresses. Peaks corresponding to a variety of ions originating from the sample appear on the time-of-flight spectrum. Each peak represents the intensity of ions after completing a certain number of turns along the loop orbit P. However, the number of their turns, i.e. their flight distance, is unknown. Hence, unlike a general time-of-flight mass spectrometer, it is not possible to obtain a mass spectrum by converting the time axis of this time-of-flight spectrum into a mass axis.

Figure 2:
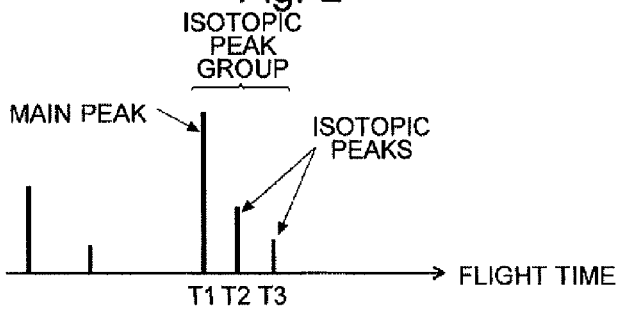
FIG. 2 is an explanation diagram for the data processing of the multi-turn time-of-flight mass spectrometer of the present embodiment.

Given that factor, in the mass spectrometer according to the present embodiment, a characterizing data processing as follows is perforated to the time-of-flight spectrum obtained in the previously described manner to compute the mass of the target component. First, the isotopic peak detector 82 collects the time of appearance and the intensity of each of the peaks appearing on the time-of-flight spectrum and, based on both of them, finds an isotopic peak group originating form the same component. As previously described, an isotopic peak group is composed of a peak of the main ion consisting only of the isotope having the largest natural abundance ratio and an isotopic peak or peaks of ions containing another isotope (or isotopic ions). FIG. 2 shows an example of the isotopic peak group on a time-of-flight spectrum.

If a plurality of peaks belonging to one isotopic peak group are based on ions that have completed the same number of turns and the ions are singly-charged, the time difference of two adjacent peaks should be equivalent to 1 Da. That is, in FIG. 2, the lengths of time T2−T1 and T3−T2 are each equivalent to 1 Da. In addition, the intensity ratio of a plurality of peaks composing an isotopic peak group should be based on the natural abundance ratio of the isotopes of the elements which compose the peaks. Hence, the isotopic peak detector 82 can detect an isotopic peak group by using the time differences and intensity ratios of a plurality of peaks.

When an isotopic peak group is detected, the flight distance computation unit 83 and the mass computation unit 84 compute the flight distance and the mass based on a computational principle as follows.

Generally, in a time-of-flight mass spectrometer, the relationship between the flight time T and the flight distance L of an ion is given by the following formula (1):

$$T=L/v \quad (1),$$

where v denotes the velocity of the ion. The relationship between the kinetic energy U of the ion and the mass m of the ion is given by the following formula (2):

$$v=\sqrt{(2U/m)} \quad (2).$$

From the formulas (1) and (2), the following formula (3) is obtained:

$$m=2U(T/L)^2 \quad (3).$$

Since the number of turns of the ions which cause each peak cannot be known from the previously described time-of-flight spectrum, the flight distance L in the aforementioned formulas is unknown. Here, let:

$$\alpha=2U/L^2.$$

Then, the formula (3) can be rewritten as:

$$m=\alpha T^2 \quad (4).$$

In the case where the time difference T2−T1 of the two adjacent peaks illustrated in FIG. 2 is equivalent to 1 Da, they have the same kinetic energy U and the flight distance L.

Hence, from the formula (4), the following formulas are obtained:

$$M=\alpha T1^2 \quad (5), \text{ and}$$

$$M+1=\alpha T2^2 \quad (6),$$

where M is the mass of the ion from which the main peak has originated.

From the formulas (5) and (6), $$1-\alpha(T2^2-T1^2),$$

$$\alpha=2U/L^2=(T2^2-T1^2), \text{ and}$$

$$L^2=2U/(T2^2-T1^2)$$

are obtained. Hence, $$L=\sqrt{\{2U/(T2^2-T1^2)\}} \quad (7).$$

In this manner, the flight distance L can be obtained from the times of appearance T1 and T2 of the two peaks.

Once the flight distance L is obtained, the mass of the ions originating from the target component can be computed from the formula (3). In order to perform an accurate computation, it is preferable to compute the number of turns from the flight distance L obtained from the formula (7), and compute a more exact flight distance by using the number of turns. This is because, the orbit length of one loop of the loop orbit P, the distance from the ion source 1 to the gate electrode 2, the distance from the gate electrode 2 to the detector 4, and other values are determined from the configuration such as the arrangement of the sector-shaped electrodes 31 through 36 and the position of the ion source 1 and the detector 1; if only the number of turns is determined, the flight distance can be accurately computed.

As previously described, it is possible to accurately compute the mass of the ion originating from the target component whose isotopic peak group has been detected. The computation of the flight distance (i.e. the number of turns) and the computation of the mass as previously described can be performed for each isotopic peak group, by using the times of appearance of the peaks which belong to the isotopic peak group. Therefore, it is only necessary to identify the isotopic peak group of the target component to acquire the mass of the target component with a high mass resolution.

It should be noted that the embodiment described thus far is merely an example of the present invention, and it is evident that any modification, adjustment, or addition appropriately made within the spirit of the present invention is also included in the scope of the claims of the present application.

The invention claimed is:

1. A multi-turn time-of-flight mass spectrometer including: an ion source for ionizing a sample; an ion optical system for forming a loop orbit along which ions originating from the sample are made to fly repeatedly; and a detector for detecting ions which have flown along the loop orbit, comprising:

a) a spectrum creator for creating a time-of-flight spectrum based on a signal obtained by the detector after ions originating from the sample are made to fly along the loop orbit for a predetermined period of time;

b) an isotopic peak detector for detecting a peak of a target component and a peak of an isotope of the target component based on times of appearance and intensities of a plurality of peaks on the time-of-flight spectrum created by the spectrum creator; and c) a mass computing means for deducing a flight distance of an ion originating from the target component, based on the times of appearance of the plurality of peaks detected as the peak of the target component and the peak of the isotope on the time-of-flight spectrum and based on the kinetic energy of the ions, and for computing a mass of the target component based on the flight distance.

2. The mass spectrometer according to claim 1, wherein: the isotopic peak detector detects the peak of the target component and the peak of the isotope of the target component not only from time differences obtained from the times of appearance of the plurality of peaks, but also by examining whether the intensity ratio of the plurality of peaks corresponds to an isotope abundance ratio of elements constituting the target component.

3. The mass spectrometer according to claim 1, wherein: the mass computing means computes a number of turns of ions originating from the target component from the deduced flight distance, recomputes an accurate structurally-determined flight distance from the number of turns, and computes the mass of the target component.

4. The mass spectrometer according to claim 2, wherein: the mass computing means computes a number of turns of ions originating from the target component from the deduced flight distance, recomputes an accurate structurally-determined flight distance from the number of turns, and computes the mass of the target component.

* * * * *